US006330842B1

(12) United States Patent
Brun

(10) Patent No.: US 6,330,842 B1
(45) Date of Patent: Dec. 18, 2001

(54) COMPACT HEAD POWER DRIVEN RATCHET TOOL

(76) Inventor: Kevin Brun, 1509 Grant St., #B, Berkeley, CA (US) 94703

( * ) Notice: Subject to any disclaimer, the term of this patent is extended or adjusted under 35 U.S.C. 154(b) by 0 days.

(21) Appl. No.: 09/603,775

(22) Filed: Jun. 26, 2000

(51) Int. Cl.[7] ..... B25B 13/46
(52) U.S. Cl. ..... 81/57.39; 81/63.2
(58) Field of Search ..... 81/57.39, 60–63.2

(56) References Cited

U.S. PATENT DOCUMENTS

| | | | | |
|---|---|---|---|---|
| 3,078,973 | * | 2/1963 | Kilness | 81/63.2 X |
| 3,786,698 | | 1/1974 | Diehl et al. . | |
| 4,339,968 | * | 7/1982 | Krieger | 81/57.39 |
| 4,346,630 | | 8/1982 | Hanson . | |
| 4,372,181 | | 2/1983 | Tinsley . | |
| 4,765,210 | * | 8/1988 | Mierbach et al. | 81/57.39 |
| 5,022,289 | | 6/1991 | Butzen . | |
| 5,203,238 | * | 4/1993 | Ferguson | 81/57.39 |
| 5,351,583 | * | 10/1994 | Szymber et al. | 81/60 |
| 5,450,773 | | 9/1995 | Darrah et al. . | |
| 5,584,220 | | 12/1996 | Darrah et al. . | |
| 5,896,789 | | 4/1999 | Giardino . | |
| 5,967,002 | | 10/1999 | Pijanowski . | |
| 6,065,374 | * | 5/2000 | Taggart | 81/63 X |
| 6,148,694 | * | 11/2000 | Spirer | 81/57.39 X |

* cited by examiner

*Primary Examiner*—James G. Smith
(74) *Attorney, Agent, or Firm*—Harris Zimmerman

(57) ABSTRACT

A power driven ratchet tool includes a generally tubular handle having a drive motor and transmission supported therein, and a driver assembly releasably secured to the handle. The driver assembly includes a tubular housing having a drive shaft extending therethrough and coupled to the motor through the transmission. A wrench head housing at the distal end of the housing includes a drive socket having an aperture therethrough configured to engage a standard threaded component. The drive socket includes gear teeth extending about the periphery thereof. The drive shaft supports an eccentric crank at its distal end to engage a slot opening in a drive pawl pin disposed within the head housing. The drive pawl pin is constrained to translate within the housing in a reciprocal arcuate path concentric to the drive socket axis. A drive pawl includes a central aperture for receiving and securing the drive pawl pin in freely rotating fashion, the drive pawl including a plurality of drive teeth extending eccentrically therefrom to releasably engage the gear teeth of the drive socket. A pawl spring impinges on the drive pawl to bias the pawl to rotate about the drive pawl pin. As the drive shaft rotates, the crank moves the drive pawl pin laterally in a first direction in the head housing, causing the drive pawl to translate therewith. The pawl spring rotates the drive pawl so that the pawl teeth engage the gear teeth, whereby the pawl translation results in incremental rotation of the drive socket.

15 Claims, 5 Drawing Sheets

COMPACT HEAD POWER DRIVEN RATCHET TOOL

BACKGROUND OF THE INVENTION

The present invention relates to ratchet wrenches and, more particularly, to powered ratchet wrenches.

Conventional powered ratchet wrenches generally employ an electrical or pneumatic motor coupled to a ratchet mechanism through a transmission. The output shaft of the motor turns a transmission input shaft, and the output shaft of the transmission turns a crankshaft. The crankshaft eccentric rotation oscillates a ratchet yoke. The movement of the ratchet yoke causes a pawl to engage and rotate the ratchet spindle or tool head of a ratchet mechanism to rotate so that a bolt, nut, or other threaded part engaged therein is tightened or loosened.

The ratchet yoke comprises a large component within the head of the wrench, and necessitates a wrench head that is larger than would otherwise be necessary if the yoke could be eliminated. It is desirable to provide a wrench head as small as possible to reach into restricted spaces, and any measure that reduces the size of the wrench head is considered an important advance in the art.

SUMMARY OF THE INVENTION

The present invention generally comprises a power driven ratchet tool that features a novel drive mechanism that provides a compact wrench head.

The tool includes a generally tubular handle having a drive motor and transmission supported therein, and a driver assembly extending axially from the handle and releasably secured thereto. The driver assembly includes a box end socket driver assembly for engaging a hex head bolt or nut, or a square drive opening. A plurality of interchangeable driver assemblies may be provided to engage a wide range of sizes of bolt heads or nuts.

Each driver assembly includes a tubular housing having a drive shaft extending axially therethrough and adapted to couple at the proximal end to the motor and transmission in the handle. The distal end of the housing supports a wrench head housing that flares distally to a rounded end. A drive socket is supported in the wrench head housing, and includes an aperture therethrough configured to engage a standard threaded component. The drive socket also includes gear teeth extending about the periphery thereof within the head housing. At least one socket detent ball is supported in the head housing and resiliently biased to impinge on the gear teeth to restrain rotation of the drive socket.

The drive shaft supports an eccentric crank at its distal end, the crank being disposed within the wrench head housing. A drive pawl pin is disposed within the head housing, extending transversely to the axis of the drive shaft and parallel to the axis of the drive socket. The drive pawl pin includes an opening therethrough to receive the crank freely, whereby the drive pawl pin is driven to reciprocate. The drive pawl pin is constrained by channels in the housing to translate within the housing in a reciprocal arcuate path that is transverse to the drive shaft axis and concentric to the drive socket axis.

A drive pawl includes a central aperture for receiving and securing the drive pawl pin in freely rotating fashion, whereby the drive pawl is driven to translate reciprocally with the drive pawl pin. The drive pawl also include a plurality of drive teeth extending eccentrically therefrom to releasably engage the gear teeth of the drive socket. A pawl spring impinges on the drive pawl to bias the pawl to rotate about the drive pawl pin.

As the drive shaft rotates, the crank moves the drive pawl pin laterally in a first direction in the head housing, causing the drive pawl to translate therewith. The pawl spring rotates the drive pawl so that the pawl teeth engage the gear teeth, whereby the pawl translation results in incremental rotation of the drive socket. As the crank moves in the second, opposite direction, the pawl teeth disengage the drive socket gear teeth, and the drive pawl in translated to return laterally and re-engage the drive socket gear teeth when the crank begins to translate in the first direction once again. The socket detent ball prevents counter-rotation of the drive socket by the return motion of the drive pawl. This cycle is reiterated quickly and indefinitely until the threaded component engaged by the drive socket is completely tightened or loosened, under the control of the wrench user.

DESCRIPTION OF THE PREFERRED EMBODIMENT

Figure 1:
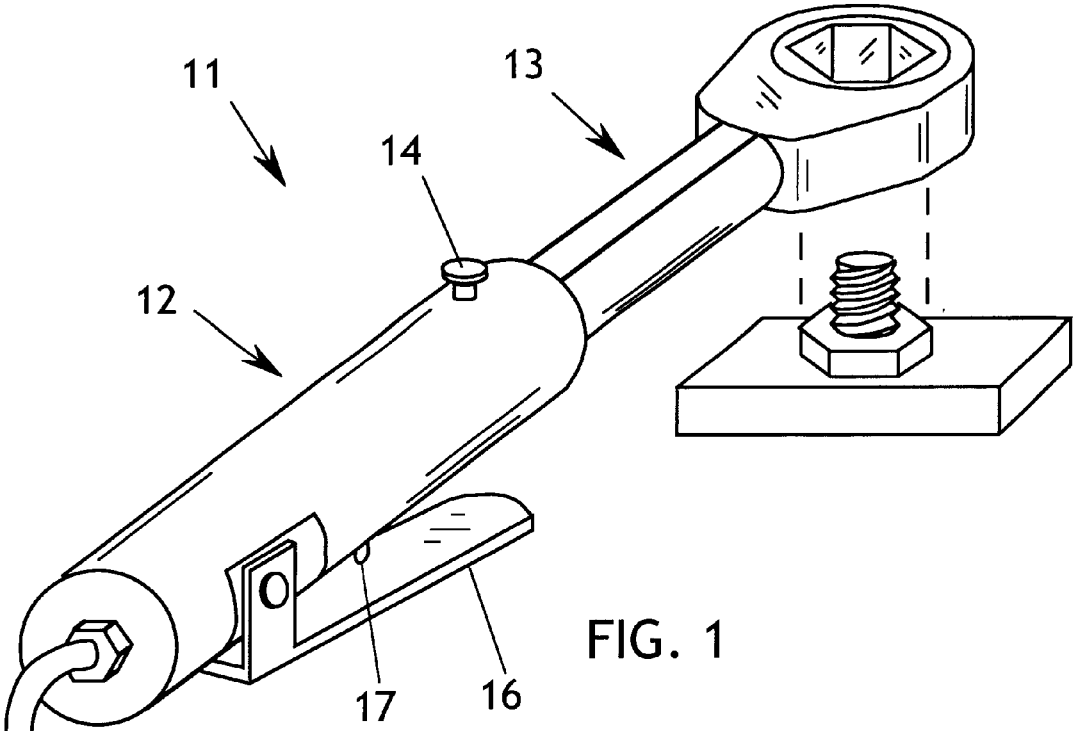
FIG. 1 is a perspective view of the power driven ratchet tool of the present invention.

The present invention generally comprises a power driven ratchet tool that features a novel drive mechanism that provides a compact wrench head. With regard to FIG. 1, the tool 11 generally comprises a handle assembly 12, and a driver assembly 13 that is releasably secured to the handle assembly 12 by a mechanism operated by release button 14. An trigger lever 16 is pivotally secured to the handle assembly 12, and is arranged to be squeezed to actuate a button switch 17 that operates a motor within the handle assembly. The motor may be electric, and powered by battery or cable 18. Alternatively, the motor may be pneumatic, in which case the cable 18 comprises a pneumatic supply hose.

Figure 2:
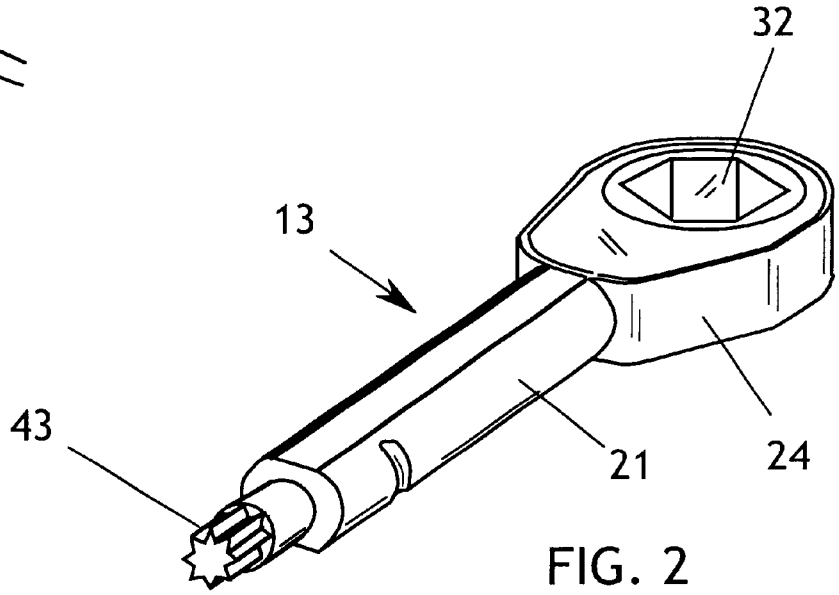
FIG. 2 is a perspective view of the removable driver assembly of the power driven ratchet tool shown in FIG. 1.
Figure 3:
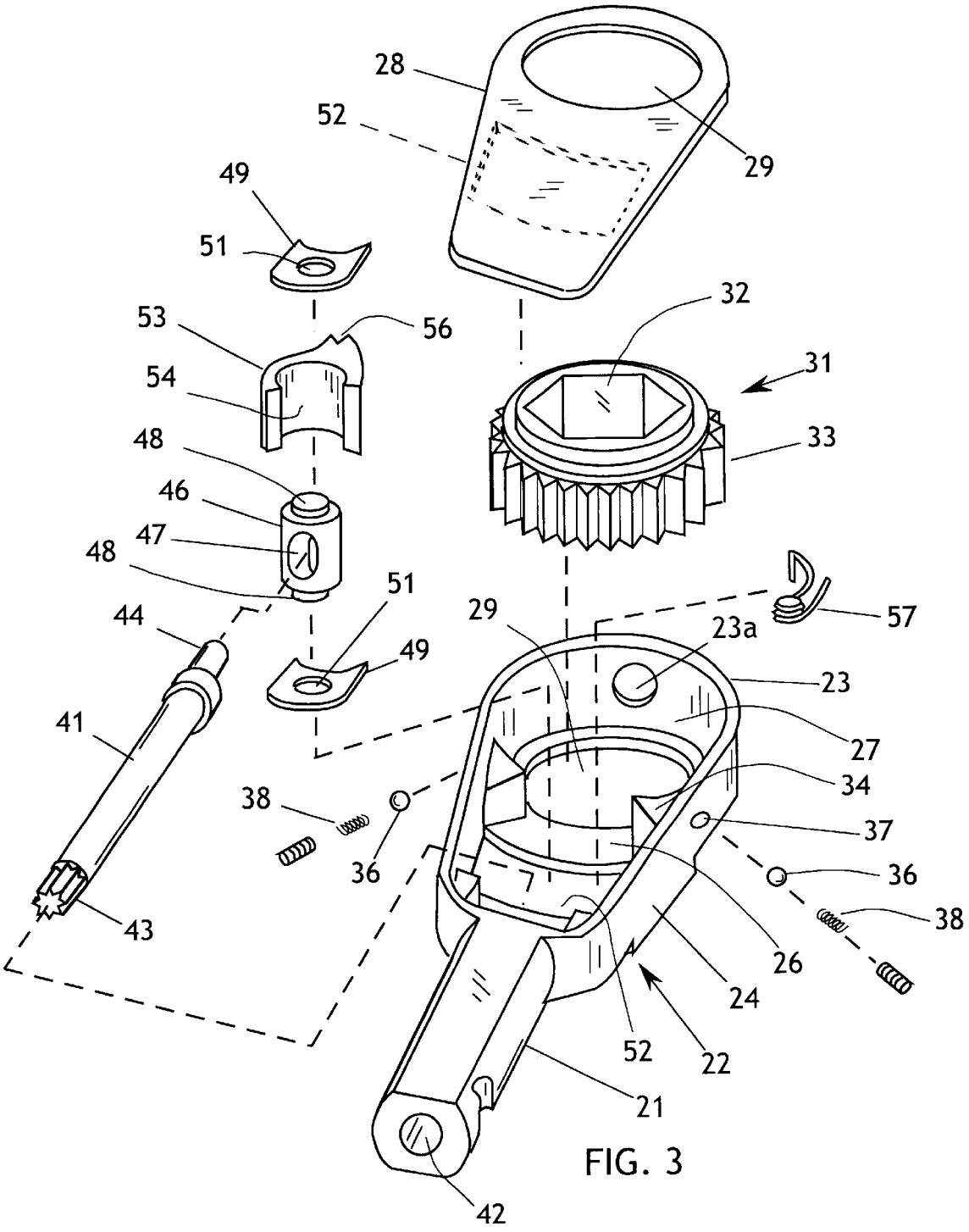
FIG. 3 is an exploded view of the removable driver assembly depicted in FIG. 2.
Figure 8:
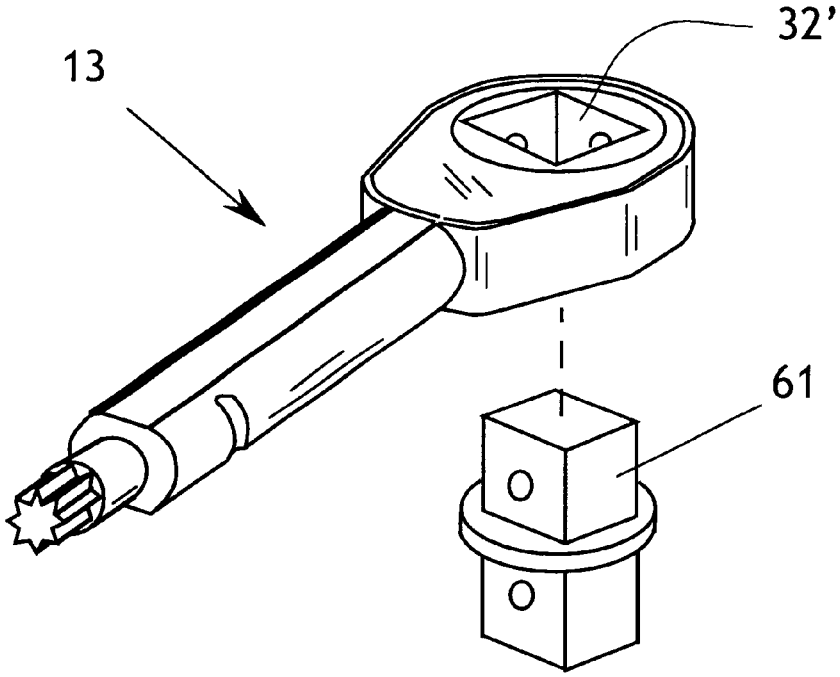
FIG. 8 is a perspective view of another embodiment of the driver assembly of the present invention.

With regard to FIGS. 2 and 3, each driver assembly 13 includes a tubular housing 21 extending longitudinally and axially with respect to the handle assembly 12. At the distal end of the tubular housing 21, there is supported a wrench head housing 22 that includes a closed curved sidewall 24 flaring outwardly to a rounded distal end 23. An opening 23*a* in the housing 22 provides a means to install the crankshaft (described below). The housing 22 includes an end wall 26 that spans the sidewall 24 and defines an interior cavity 27. A removable cover plate 28 is secured to the sidewall 24 to enclose the cavity 27. The cover plate 28 and end wall 26 include aligned circular openings 29 extending therethrough. The driver assembly 13 includes a drive socket 31, comprised of a disk-like component having a central aperture 32 configured to receive a hex-shaped threaded component of standard size, or a square drive component, as shown in FIG. 8, or any other standard threaded component shape. The drive socket 31 also includes gear teeth 33 extending uniformly about the periphery thereof, the teeth edges extending parallel to the axis of the disk. The drive socket 31 is received within the cavity 27, adjacent to the rounded end of the sidewall 24, and is retained in place by internal blocks 34. The central aperture 32 is axially aligned with the openings 29, so that the aperture 32 is accessible from both sides of the driver assembly. A pair of socket detent balls 36 are supported in bores 37 extending through the blocks 34, and resiliently biased by springs 38 to impinge on the teeth 33 of the driver socket 31 to retard rotation of the driver socket.

Figure 7:
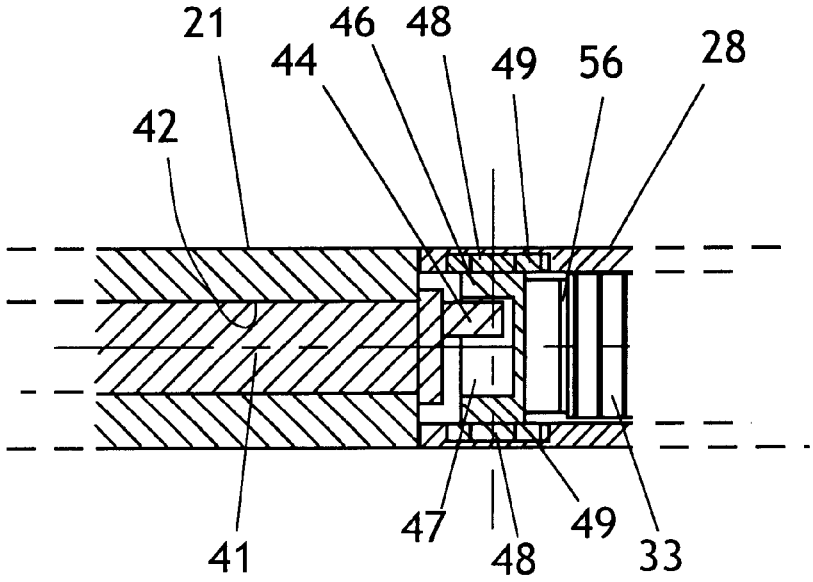
FIG. 7 is an enlarged fragmentary cross-sectional elevation of the drive pawl pin and crank assembly and the engagement of the drive pawl and drive socket.

With additional reference to FIG. 7, the driver assembly also includes a drive shaft 41 extending axially through bore 42 of housing 21. The proximal end of the shaft 41 includes gear teeth 43 to engage the output shaft of a transmission in the handle assembly, and the distal end includes a crank 44 extending parallel to the axis and eccentric thereto. The crank 44 is disposed in a proximal portion of the cavity 27. A drive pawl pin 46 is disposed in the proximal portion of the cavity 27, extending transversely to the axis of the drive shaft 41 and parallel to the axis of the drive socket 31. Extending laterally through the drive pawl pin 46 is an elongated opening 47 that is dimensioned to receive the crank 44 in freely translating fashion. The length of the opening 47 permits free movement of the crank in the vertical direction (parallel to the axis of the drive socket 31), while lateral movement of the crank (transverse to the axis of the shaft 41 and to the axis of the drive socket 31) translates the drive pawl pin to reciprocate in the lateral direction.

The drive pawl pin 46 includes ends 48 that are received in holes 51 of a pair of guide plates 49, whereby the guide plates are translated reciprocally in the lateral direction by the drive pawl pin 46. The guide plates 49 are received in slidable engagement within respective channels 52 formed in the inner surfaces of the end wall 26 and the cover plate 28. The channels 52 are formed with lateral edges that are curved in concentric relationship to the axis of the drive socket 31, and the guide plates also include lateral edges with complementary curvature, whereby the guide plates 49 and the drive pawl pin 46 are constrained to translate reciprocally in an arc about the drive socket.

The mechanism also includes a drive pawl 53 provided with a central passage 54 configured to engage the drive pawl pin 46 in freely rotating fashion. The passage 54 describes a partial cylindrical opening having an angular extent greater than 180° to maintain engagement of the pin 46 without interfering with the interaction of the crank 44 in the opening 47. The drive pawl 53 includes an eccentric protrusion that terminates in a plurality (preferably two) pawl teeth 56 that are adapted for engagement with the gear teeth 33 of the drive socket 31. The drive pawl 53 is constrained between the end wall 26 and the cover plate 28, and the pawl 53 translates arcuately in concert with the pawl pin 46. The mechanism also provides a pawl spring 57 secured within the cavity 27 and disposed to exert a resilient force between the sidewall 24 and the eccentric portion of the drive pawl 56.

Figure 6:
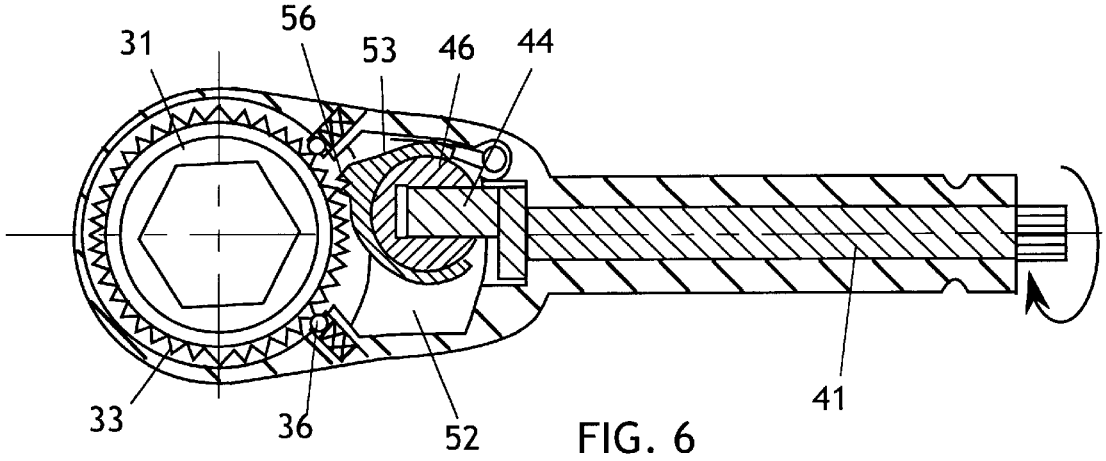
FIGS. 4–6 are a sequence of schematic plan views of the removable driver assembly, showing the stages of operation of the drive mechanism.
Figure 5:
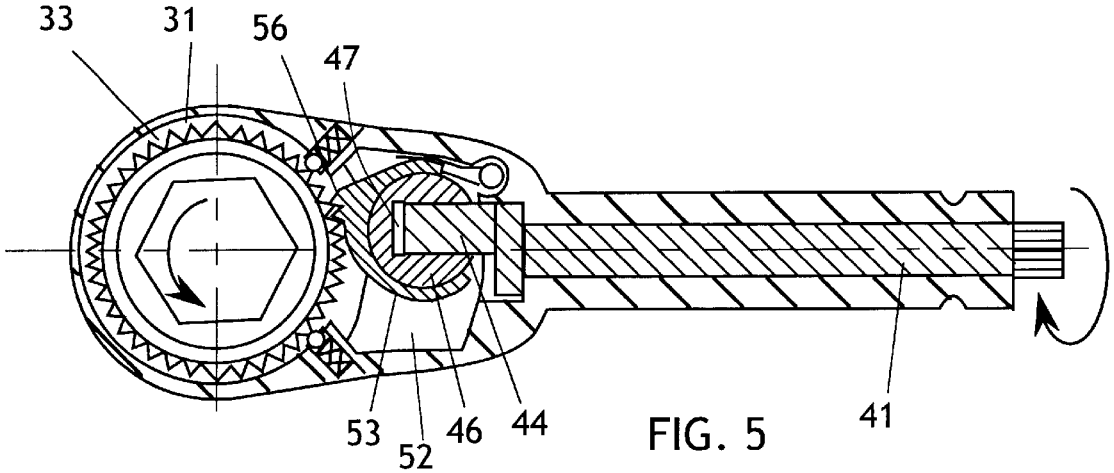
Figure 4:
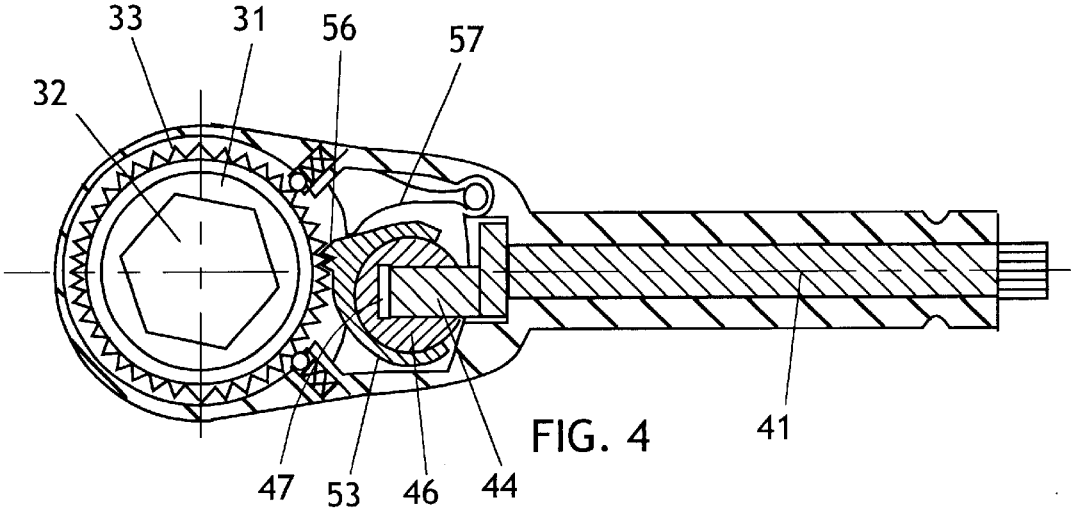

To explain the operation of the mechanism described above, reference is made to FIGS. 4–6. In FIG. 4, the crank 44 is rotated to one lateral extreme, and the drive pawl 53 is biased by spring 57 to rotate counterclockwise (as seen in FIG. 4), bringing the drive pawl teeth 56 into engagement with the gear teeth 33 of the drive socket 31. As the shaft 41 rotates to the position shown in FIG. 5, the arcuate movement of the drive pawl 53 causes the drive socket 31 to be rotated through an angular excursion of several degrees (approximately 5°–20°). When the crank reaches the other lateral extreme (FIG. 5) and begins the return stroke, the engagement of the pawl teeth 56 in the gear teeth 33, together with the movement of the drive pawl toward the position of FIG. 4, causes the drive pawl to rotate clockwise (against the bias of pawl spring 57), and the pawl teeth 56 release from the gear teeth 33 (FIG. 6). The drive pawl is thus free to return to the position of FIG. 4 to begin another operating cycle. The socket detent balls 36 maintain the position of the drive socket 31 against any drag that may be exerted by the returning drive pawl. Reiteration of the process described above results in counterclockwise rotation of the drive socket through whatever angular excursion is required to loosen or tighten the threaded component engaged in the opening 32.

It is noted that the drive mechanism described above is extremely compact, occupying a width and depth only slightly greater than the diameter of the drive socket. Thus the wrench head provides better access to threaded components in restricted spaces.

With reference to FIG. 8, the driver assembly 13 may be provided with a drive socket 31 having a square opening 32'. A square drive ratchet attachment 61 may be engaged in the opening 32', whereby any appropriate and commonly available square drive socket may be secured to the attachment 61. Thus the wrench quickly may be converted from box end use to socket drive use. The attachment 61 may be secured in either end of the opening 32' to effect reversal of rotational direction.

Figure 9:
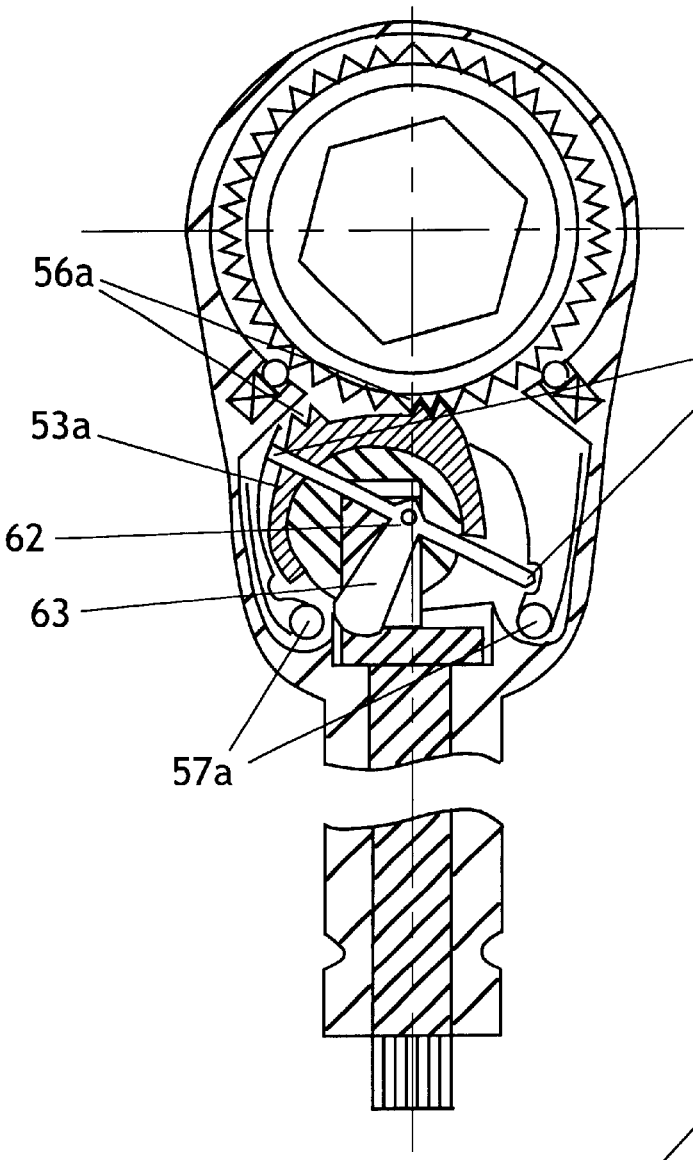
FIG. 9 is a plan view of a further embodiment of the power driven ratchet tool, adapted for bidirectional use.
Figure 10:
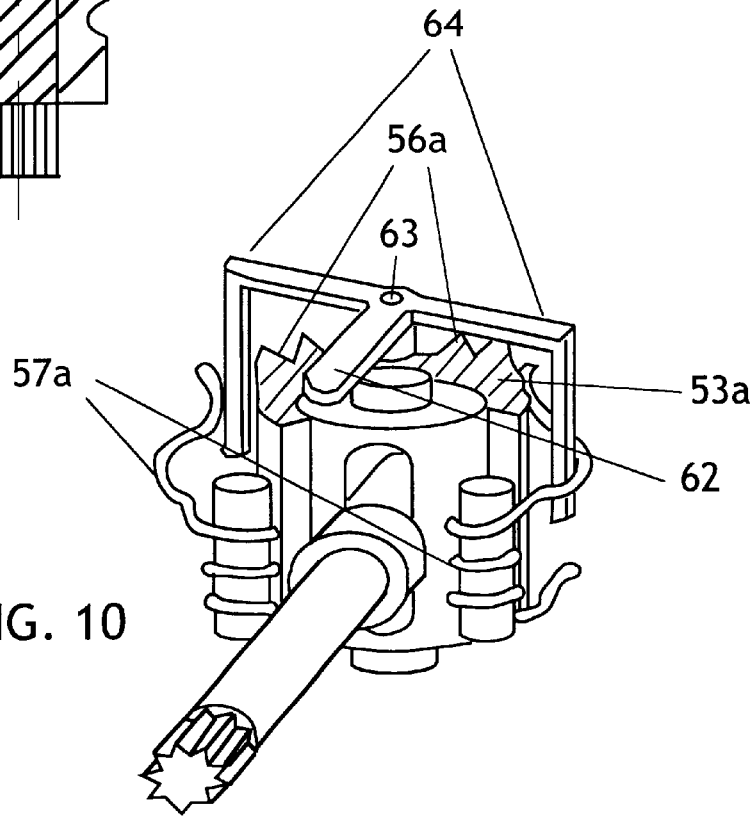
FIG. 10 is an magnified perspective view of the drive mechanism of the further embodiment depicted in FIG. 9.

A further embodiment of the invention, shown in FIGS. 9 and 10, provides a drive mechanism that is selectively reversible in rotational direction. It provides a pawl with two sets of teeth for engaging the gear teeth 33, two pawl springs and a lever to engage one pawl spring and urge it to one side of the pawl while disengaging the other pawl spring from the other side of the pawl. The pawl **53*a* has two sets of teeth 56*a* and two pawl springs 57*a* on either side of pawl 53*a*. A lever 62 is mounted in the housing. When the lever is rotated (by manual action) around pivot point 63, the arms 64 extending from the lever rotate and depress one of the springs 57*a* while releasing the other springs 57*a*. This action changes the side of the pawl on which spring pressure is exerted and thus selects one of the sets of pawl teeth 56*a* to engage the gear teeth 33. Thus the direction of rotation of the drive socket may be reversed by manual rotation of the lever 62**.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A power driven ratchet tool, including:

a wrench head housing and a tubular housing extending therefrom;

a drive shaft extending through said tubular housing to said wrench head housing;

a drive socket secured in said wrench head housing in freely rotating fashion, said drive socket including a central opening therein adapted to releasably engage a standard threaded component;

a plurality of gear teeth spaced about a peripheral surface of said drive socket;

a drive pawl disposed in said wrench head housing, said drive pawl including at least one drive tooth adapted to releasably engage said gear teeth of said drive socket;

reciprocating means coupled between said drive shaft and said drive pawl for translating said drive pawl reciprocally and urging said at least one drive tooth to engage said gear teeth and rotate said drive socket unidirectionally;

means for constraining said drive pawl to translate reciprocally in an arc that is concentric to said drive socket, said means for constraining including a pair of arcuate channels defined in two spaced apart surfaces within said wrench head housing, said drive pawl extending between said two surfaces;

said reciprocating means including a crank pin extending eccentrically from said drive shaft in said wrench head housing, said reciprocating means including a drive pawl pin extending between said two spaced apart surfaces within said wrench head housing, said drive pawl pin including an elongated opening extending therein to receive said crank pin.

2. The power driven ratchet tool of claim 1, further including means for securing said drive pawl to said drive pawl pin for reciprocal translation in common.

3. The power driven ratchet tool of claim 2, wherein said means for securing includes a partial cylindrical opening extending in said drive pawl, said drive pawl pin extending through said partial cylindrical opening in freely rotating fashion.

4. The power driven ratchet tool of claim 3, further including pawl spring means for resiliently biasing said drive pawl to rotate in a first direction about said drive pawl pin.

5. The power driven ratchet tool of claim 4, wherein rotation of said drive pawl in said first direction engages said at least one drive tooth with said gear teeth of said drive socket.

6. The power driven ratchet tool of claim 5, wherein said means for constraining includes a pair of guide plates, each disposed in one of said arcuate channels and adapted to translate freely therein, each of said pair of guide plates supporting a respective end of said drive pawl pin.

7. The power driven ratchet tool of claim 6, further including detent ball means for retarding rotation of said drive socket.

8. The power driven ratchet tool of claim 6, wherein said drive pawl pin extends along a pin axis that is generally transverse to the axis of said drive shaft and parallel to the axis of rotation of said drive socket.

9. The power driven ratchet tool of claim 8, wherein said elongated opening of said drive pawl pin extends axially in said drive pawl pin.

10. The power driven ratchet tool of claim 1, wherein said central opening of said drive socket is a hexagonal box end wrench configuration.

11. The power driven ratchet tool of claim 1, wherein said central opening of said drive socket is a square socket drive wrench configuration.

12. The power driven ratchet tool of claim 5, wherein said reciprocating means reiteratively rotates said drive pawl in a second direction to release engagement of said at least one drive tooth with said gear teeth of said drive socket.

13. The power driven ratchet tool of claim 1, further including detent ball means for retarding rotation of said drive socket.

14. A power driven ratchet tool, including:

a wrench head housing and a tubular housing extending therefrom;

a drive shaft extending through said tubular housing to said wrench head housing;

a drive socket secured in said wrench head housing in freely rotating fashion, said drive socket including a central opening therein adapted to releasably engage a standard threaded component;

a plurality of gear teeth spaced about a peripheral surface of said drive socket;

a drive pawl disposed in said wrench head housing, said drive pawl including at least one drive tooth adapted to releasably engage said gear teeth of said drive socket;

reciprocating means coupled between said drive shaft and said drive pawl for translating said drive pawl reciprocally and urging said at least one drive tooth to engage said gear teeth and rotate said drive socket unidirectionally; and, means for constraining said drive pawl to translate reciprocally in an arc that is concentric to said drive socket, said means for constraining including a pair of arcuate channels defined in two spaced apart surfaces within said wrench head housing, said drive pawl extending between said two surfaces;

said means for constraining includes a pair of guide plates, each disposed in one of said arcuate channels and adapted to translate freely therein.

15. A power driven ratchet tool, including:

a wrench head housing and a tubular housing extending therefrom;

a drive shaft extending through said tubular housing to said wrench head housing:

a drive socket secured in said wrench head housing in freely rotating fashion, said drive socket including a central opening therein adapted to releasably engage a standard threaded component;

a plurality of gear teeth spaced about a peripheral surface of said drive socket;

said drive socket being free of any circumscribing member moving thereabout;

a drive pawl disposed in said wrench head housing, said drive pawl including at least one drive tooth adapted to releasably engage said gear teeth of said drive socket;

reciprocating means coupled between said drive shaft and said drive pawl for translating said drive pawl reciprocally and urging said at least one drive tooth to engage said gear teeth and rotate said drive socket unidirectionally; and, means for constraining said drive pawl to translate reciprocally in an arc that is concentric to said drive socket, said means for constraining including a pair of arcuate channels defined in two spaced apart surfaces within said wrench head housing, said drive pawl extending between said two surfaces.

* * * * *